US011806295B2

(12) United States Patent
Patmore et al.

(10) Patent No.: US 11,806,295 B2
(45) Date of Patent: Nov. 7, 2023

(54) PATIENT SUPPORT APPARATUS WITH PORTABLE CHARGING DEVICE

(71) Applicant: Stryker Corporation, Kalamazoo, MI (US)

(72) Inventors: Kevin M. Patmore, Plainwell, MI (US); Krishna S. Bhimavarapu, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 401 days.

(21) Appl. No.: 17/166,099

(22) Filed: Feb. 3, 2021

(65) Prior Publication Data

US 2021/0154068 A1 May 27, 2021

Related U.S. Application Data

(63) Continuation of application No. 16/210,878, filed on Dec. 5, 2018, now Pat. No. 10,940,068.

(60) Provisional application No. 62/608,838, filed on Dec. 21, 2017.

(51) Int. Cl.
*A61G 7/05* (2006.01)
*A61G 1/02* (2006.01)

(52) U.S. Cl.
CPC ..... *A61G 7/0524* (2016.11); *A61G 7/0509* (2016.11); *A61G 7/0528* (2016.11); *A61G 1/0281* (2013.01); *A61G 7/0503* (2013.01); *A61G 7/0506* (2013.01)

(58) Field of Classification Search
CPC ..... A61G 7/05; A61G 7/0524; A61G 7/0509; A61G 7/5014; A61G 7/0528; A61G 21/08; A61G 1/0281; A61G 7/0503; A61G 7/0506
See application file for complete search history.

(56) References Cited

U.S. PATENT DOCUMENTS

| | | | | |
|---|---|---|---|---|
| 8,347,433 | B1 | 1/2013 | Shih | |
| 9,375,374 | B2 | 6/2016 | Herman et al. | |
| 2009/0015027 | A1 | 1/2009 | Lambarth et al. | |
| 2011/0030141 | A1 | 2/2011 | Soderberg et al. | |
| 2011/0247135 | A1* | 10/2011 | Herman | A61G 7/0507 5/425 |
| 2011/0247137 | A1 | 10/2011 | Herman et al. | |
| 2013/0253291 | A1 | 9/2013 | Dixon et al. | |

(Continued)

*Primary Examiner* — Fredrick C Conley
(74) *Attorney, Agent, or Firm* — Howard & Howard Attorneys PLLC

(57) ABSTRACT

Techniques for a patient support apparatus are provided to assist in transferring power/data to an external electronic device, such as a smartphone. The patient support apparatus comprises a support structure, a power supply and a portable charging device. The charging device comprises an energy storage unit and a receiving element coupled to the energy storage unit. The receiving element is configured to wirelessly receive power. A receptacle is coupled to the support structure and comprises a surface including a sending element being coupled to the power supply. The surface is configured to receive the charging device. The charging device is removable from the surface. The sending element is configured to wirelessly transfer power to the receiving element of the charging device such that the energy storage unit of the charging device stores the transferred power for charging an external electronic device.

20 Claims, 9 Drawing Sheets

(56) References Cited

U.S. PATENT DOCUMENTS

| | | | | |
|---|---|---|---|---|
| 2016/0089283 | A1 | 3/2016 | DeLuca et al. | |
| 2016/0367420 | A1 | 12/2016 | Zerhusen et al. | |
| 2018/0049933 | A1* | 2/2018 | Newkirk | A61G 7/0506 |
| 2018/0333317 | A1 | 11/2018 | Zerhusen et al. | |
| 2019/0015276 | A1* | 1/2019 | Bhimavarapu | H02J 7/0042 |
| 2019/0192367 | A1* | 6/2019 | Patmore | A61G 7/0528 |

* cited by examiner

PATIENT SUPPORT APPARATUS WITH PORTABLE CHARGING DEVICE

CROSS-REFERENCE TO RELATED APPLICATIONS

The subject patent application is a Continuation of U.S. patent application Ser. No. 16/210,878, filed on Dec. 5, 2018, which claims priority to and all the benefits of U.S. Provisional Patent Application No. 62/608,838, filed on Dec. 21, 2017, the disclosures of each of which are hereby incorporated by reference in their entirety.

BACKGROUND

Patient support apparatuses such as hospital beds, stretchers, cots, wheelchairs, tables, recliners, and other chairs are routinely used by individuals in the hospital such as patients, nurses, doctors and visitors.

Individuals are increasingly utilizing personal electronic devices, such as smartphones and tablets, while in the hospital. In turn, individuals are increasingly demanding the availability of power supplies to provide power to charge the personal electronic devices while in the hospital. Proximity of power outlets, length of power supply cables, and forgotten or lost power supplies create challenges for hospitals.

Attempts have been made to provide the patient support apparatus with powered connection ports (e.g., USB ports, AC outlets, etc.) for receiving electrical cables to connect to personal electronic devices. However, such connection ports are exposed and highly susceptible to accumulating biomass, dirt, food particles, and the like. As such, open connection ports are unsanitary, difficult to clean, and not ideal for a hospital environment. Furthermore, the conventional connection port on the patient support apparatus is fixed at specific location thereby restricting the ability of the individual to freely move the personal electronic device during charging. In other words, the personal electronic device can only be charged when the personal electronic device is placed at, or otherwise directly connected to, the connection port.

A patient support apparatus with features designed to overcome at least the aforementioned challenges is desired.

DETAILED DESCRIPTION

I. Patient Support Apparatus Overview

Figure 1:
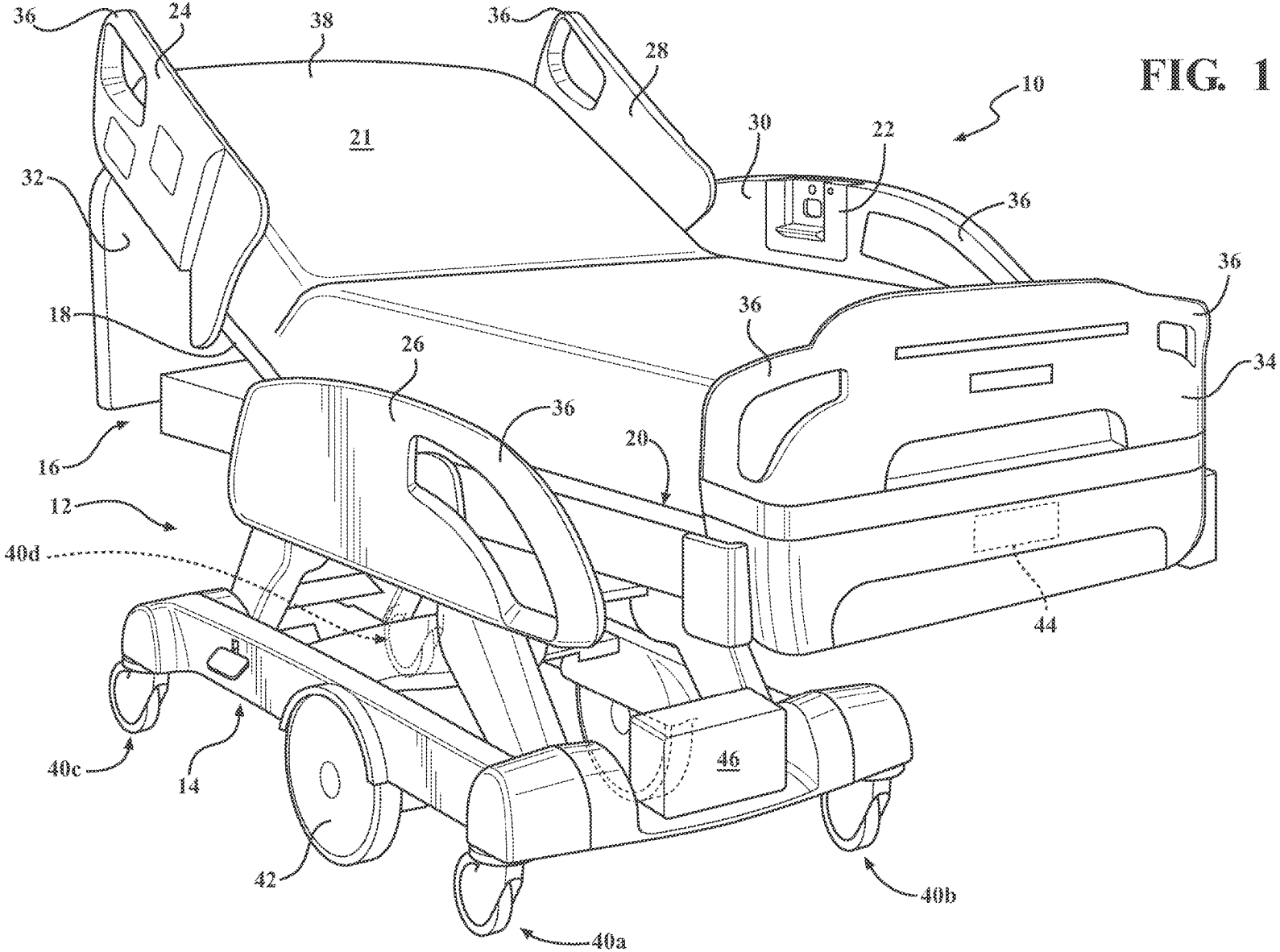
FIG. 1 is a perspective view of a patient support apparatus comprising a receptacle for receiving a portable charging device, according to one example.

Referring to FIG. 1, a patient support apparatus 10 is shown for moving a patient from one location to another. In FIG. 1, the patient support apparatus 10 is shown as a hospital bed. In other embodiments, however, the patient support apparatus 10 may be a stretcher, cot, wheelchair, chair, or similar apparatus.

A support structure 12 provides any components defining a chassis and/or body of the patient support apparatus 10. In one example, as shown in FIG. 1, the support structure 12 comprises a base 14 and an intermediate frame 16. The intermediate frame 16 is spaced above the base 14. The support structure 12 may also comprises a patient support deck 18 disposed on the intermediate frame 16. The support structure 12 and/or patient support deck 18 may comprise several sections, some of which may be pivotable relative to the intermediate frame 16, such as a head section, a seat section, a thigh section, and a foot section. The patient support deck 18 provides a patient support surface 20 upon which the patient is supported. The patient support surface 20 is supported by the base 14.

The support structure 12 may further comprise side rails 24, 26, 28, 30, which are couple to the intermediate frame 16. It will be appreciated that side rails 24, 26, 28, 30 may be considered as the support structure 12. A first side rail 24 is positioned at a right head end of the intermediate frame 16. A second side rail 26 is positioned at a right foot end of the intermediate frame 16. A third side rail 28 is positioned at a left head end of the intermediate frame 16. A fourth side rail 30 is positioned at a left foot end of the intermediate frame 16. If the patient support apparatus 10 is a stretcher or a cot, there may be fewer side rails. The side rails 24, 26, 28, 30 are movable between a raised position in which they block ingress and egress into and out of the patient support apparatus 10, one or more intermediate positions, and a lowered position in which they are not an obstacle to enable such ingress and egress. In still other configurations, the patient support apparatus 10 may not include any side rails.

A headboard 32 and a footboard 34 are coupled to the intermediate frame 16. In other embodiments, when the headboard 32 and footboard 34 are included, the headboard 32 and footboard 34 may be coupled to other locations on the patient support apparatus 10, such as the base 14. In still other embodiments, the patient support apparatus 10 does not include the headboard 32 or the footboard 34.

The support structure 12 may comprise various other panels, sections, rails, boards or frame members of the patient support apparatus 10 other than those specifically described herein.

Operator (human control) interfaces 36, such as handles, are shown integrated into the footboard 34 and side rails 24, 26, 28, 30 to facilitate movement of the patient support apparatus 10 over the floor surfaces. Additional operator interfaces 36 may be integrated into the headboard 32 and/or other components of the patient support apparatus 10. The operator interfaces 36 are graspable by the operator to manipulate the patient support apparatus 10 for movement. The operator interface 36 may comprise one or more handles coupled to the intermediate frame 16. The operator interface 36 may simply be a surface on the patient support apparatus 10 upon which the operator locally applies force to cause movement of the patient support apparatus 10 in one or more directions, also referred to as a push location. This may comprise one or more surfaces on the intermediate frame 16 or base 14. This could also comprise one or more surfaces on or adjacent to the headboard 32, footboard 34, and/or side rails 24, 26, 28, 30. In other embodiments, the operator interface 36 may comprise separate handles for each hand of the operator. For example, the operator interface 36 may comprise two handles. Other forms of the operator interface 36 are also contemplated.

A mattress 38 is disposed on the patient support deck 18. The mattress 38 comprises a direct patient support surface 21 upon which the patient is supported. The base 14, intermediate frame 16, patient support deck 18, and the patient support surfaces 20, 21 each have a head end and a foot end corresponding to the designated placement of the patient's head and foot on the patient support apparatus 10. The construction of the support structure 12 may take on any suitable design, and is not limited to that specifically set forth above or shown in FIG. 1.

One or more caster (wheel) assemblies 40 are coupled to the base 14 to facilitate transport over floor surfaces. In one example, as shown in FIG. 1, four caster assemblies 40*a*-40*d* are arranged in each of four quadrants of the base 14 adjacent to corners of the base 14. In the embodiment shown, the caster assemblies 40*a*-40*d* are able to rotate and swivel relative to the support structure 12 during transport. In still other embodiments, the patient support apparatus 10 may not include a caster assembly 40.

The caster assemblies 40 may be non-steerable, steerable, non-powered, powered (driven), or any combinations thereof. The caster assemblies 40 may have any suitable shape or configuration other than those shown in the Figures.

The patient support apparatus 10 may comprise any suitable number of caster assemblies 40, such as two or six, etc. The caster assemblies 40 may have any suitable configuration and arrangement depending on the specific type of patient support apparatus 10.

The caster assembly 40 comprises one or more wheels that may be airless (non-pneumatic), inflatable, pneumatic or semi-pneumatic. The caster assembly 40 may be coupled to the base 14 according to any suitable manner and using any suitable fastening mechanism. Caster assemblies 40 and structures, functions and applications thereof may be like those described in U.S. Patent Application Publication No. 2016/0089283, entitled "Patient Support Apparatus," the disclosure of which is hereby incorporated by reference in its entirety.

Additionally, one or more auxiliary wheels 42 (powered or non-powered) may be coupled to the support structure 12. The auxiliary wheel 42 may be movable between stowed positions and deployed positions. In some cases, when these auxiliary wheels 42 are located between the caster assemblies 40 and contact the floor surface in the deployed position, they cause two of the caster assemblies 40 to be lifted off the floor surface thereby shortening a wheel base of the patient support apparatus 10. Such auxiliary wheels 42 may also be arranged substantially in a center of the base 14.

The patient support apparatus 10 comprises a controller 44 in communication with and for controlling any suitable components of the patient support apparatus 10, such as the electrical or electromechanical components described herein. The controller 44 may comprise any suitable signal processing means, computer executable instructions or software modules stored in a non-transitory memory wherein the executable instructions or modules may be executed by a processor, or the like. Additionally, or alternatively, the controller 44 may comprise a microcontroller, a processor, one or more integrated circuits, logic parts, and the like for enabling the same. The controller 44 may have any suitable configuration for enabling performance of various tasks related to operation of the patient support apparatus 10, such as those described below. The controller 44 may be located at any suitable location of the patient support apparatus 10.

The patient support apparatus 10 requires power for energizing one or more electrically powered devices coupled to the patient support apparatus 10, such as those described above, in addition to any display devices, sensors, indicators, actuators, sub-systems (e.g., patient scale system), and the like. The patient support apparatus 10 may be coupled to, or otherwise include, a power supply 46. The patient support apparatus 10 may be energized using energy from the power supply 46. The power supply 46 may be any suitable source of power, such as another energy storage device (battery, etc.) or may be general-purpose alternating-current (AC) electric power supply of a facility, such as a hospital, or the like. In one embodiment, the power supply 46, as shown in FIG. 1, which is coupled to the one or more devices through an electrical distribution of the patient support apparatus 10.

The power supply 46 may be any suitable device for storing energy to power the electrical devices. For example, the power supply 46 may be a battery, such as a Lead-acid or Lithium ion battery, a capacitor (such as a supercapacitor), or the like. The power supply 46 may be a primary cell (one use) or a rechargeable cell (more than one use). The power supply 46 may be disposed at any suitable location on the patient support apparatus 10 or components thereof. For example, as shown in FIG. 1, the power supply 46 is fixed to the base 14. The controller 44 may comprise and/or control switches, relays, logic, circuits or any other suitable hardware and/or software for managing energy supplied to and/or energy discharged from the power supply 46. The power supply 46 may be of any suitable configuration for powering the devices of the patient support apparatus 10. It is to be appreciated that the patient support apparatus 10 may be energized using any other source of power besides electrical power, such as mechanical and/or chemical-based power, or the like.

II. Portable Charging Device, Receptacle and Power/Data Transfer Techniques

In accordance to FIGS. 2-9, and as will be understood from the various embodiments below, techniques and embodiments are shown for providing the patient support apparatus 10 with a receptacle 22 that is configured to receive and wirelessly communicate with and/or charge a portable charging device 62. The portable charging device 62 can be removed from the receptacle 22 and is configured to communicate with and/or charge an external electronic device 64.

It will be appreciated that the receptacle 22 may be configured to receive and wirelessly communicate with and/or charge the external electronic device 64.

In one example, the external electronic device 64 is a consumer-grade device, such as a smartphone, tablet, laptop, etc. However, the techniques described herein may be utilized with any other device, such as hospital devices, and the like.

The techniques described herein satisfy demands of power supply availability for the patient support apparatus 10 while eliminating hassle associated with locating power outlets and managing or finding lost power supply cables. As will be understood from the description herein, the receptacle 22 configured to reduce exposed connection ports thereby being less susceptible to accumulating biomass, dirt, food particles, and the like. In turn, the receptacle 22 provides a sanitary and easily cleanable surface ideal for hospital environments.

Furthermore, the charging device 62 is portable to conveniently provide charging and/or data transfer with the external electronic device 64 at any location. The charging device 62 is free to move such that charging and/or data transfer capabilities are possible without being fixed or tethered to a limited location to the patient support apparatus 10.

The techniques herein provide the receptacle 22 with the capability of transferring power/data wirelessly to the portable charging device 62. In other words, the receptacle 22 transfers power/data to the charging device 62 without using a direct electrical and physical connection, such as conductive wire/cable/cord (e.g., plugged into the receptacle 22). As used herein, the term "wireless" relates to the transfer of power/data and may embody various wireless techniques for transferring power/data to the charging device 62, such as electrical, inductive, capacitive electromagnetic, and electro-mechanical techniques. Thus, the term "wireless" is not limited to radio frequency or microwave signal transfer, as generally used in communication systems. As will be described below, the charging device 62 may transfer power/data to charge the external electronic device 64 using a wireless and/or wired configuration.

Referring now to example configurations to implement these techniques, the receptacle 22 comprises a first surface 48 including a first sending element 50, a first securing mechanism 52, a second surface 54 including a second sending element 56 and a second securing mechanism 58 and an indicator 60. The first sending element 50 is coupled to the power supply 46 and configured to receive the charging device 62. The various functionality of these components will be described in detail below.

Figure 2:
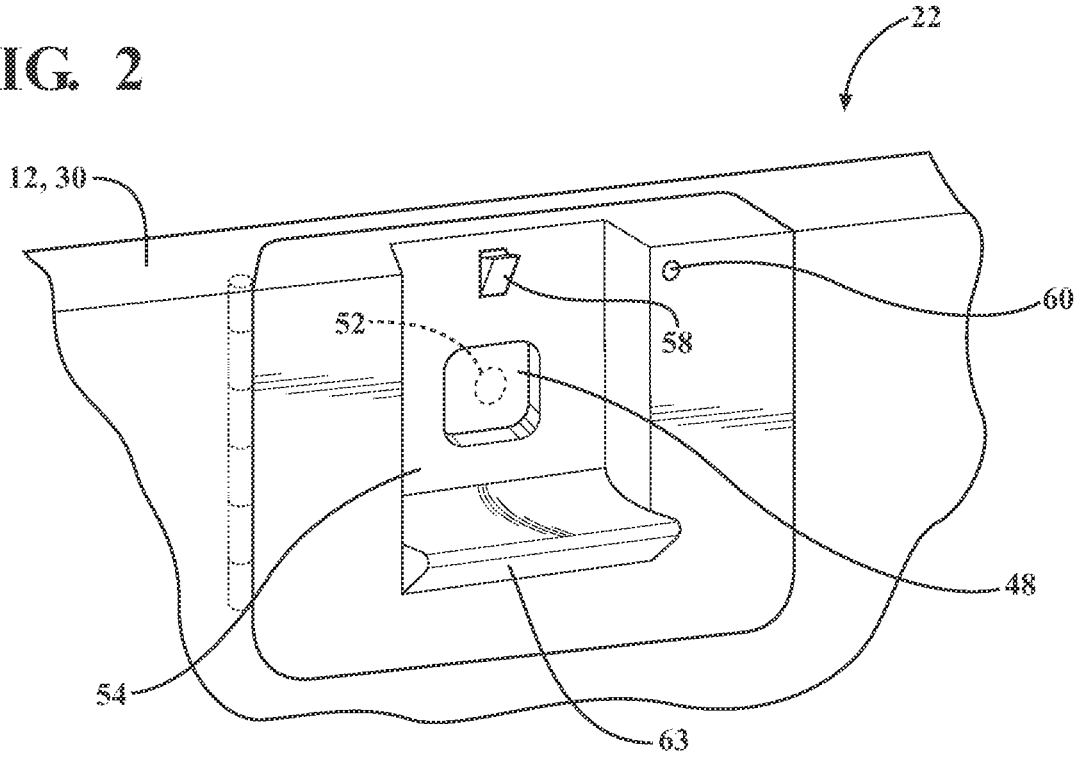
FIG. 2 is a perspective view, partially in phantom, of the receptacle, according to one embodiment.

The receptacle 22 is coupled to support structure 12, or one or more components of the support structure 12. The receptacle 22 may be integrated with the support structure 12 or attached to the support structure 12. The receptacle 22 is shown in FIGS. 1-2C integrated into one of the side rails 30. In other embodiments, the receptacle 22 may be coupled to other support structure 12 components, such as the headboard 32, or footboard 34, etc. It will be appreciated that the receptacle 22 may be integrated facing outwards from the patient support apparatus 10. It will be further appreciated that the receptacle 22 is not limited to the configuration and design shown in the FIGS. 2A-2C.

Figure 2A:
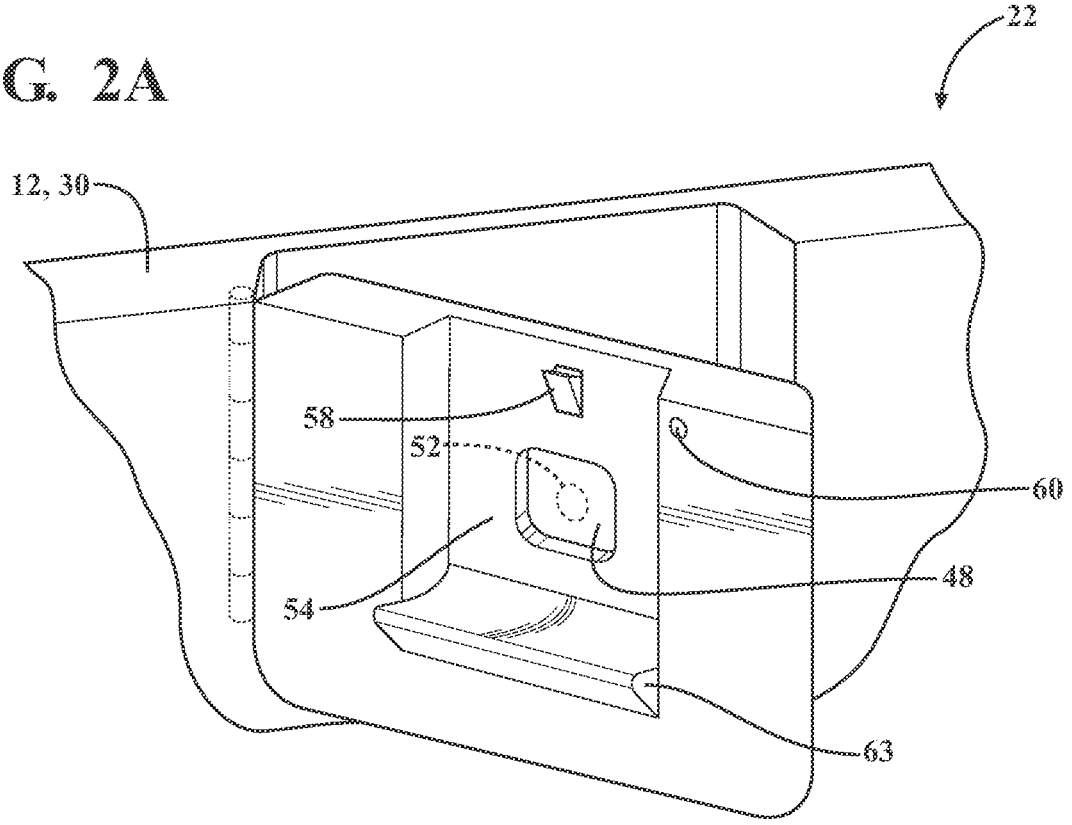
FIG. 2A is the view of FIG. 2, wherein the receptacle is pivoted, according to one example.
Figure 2B:
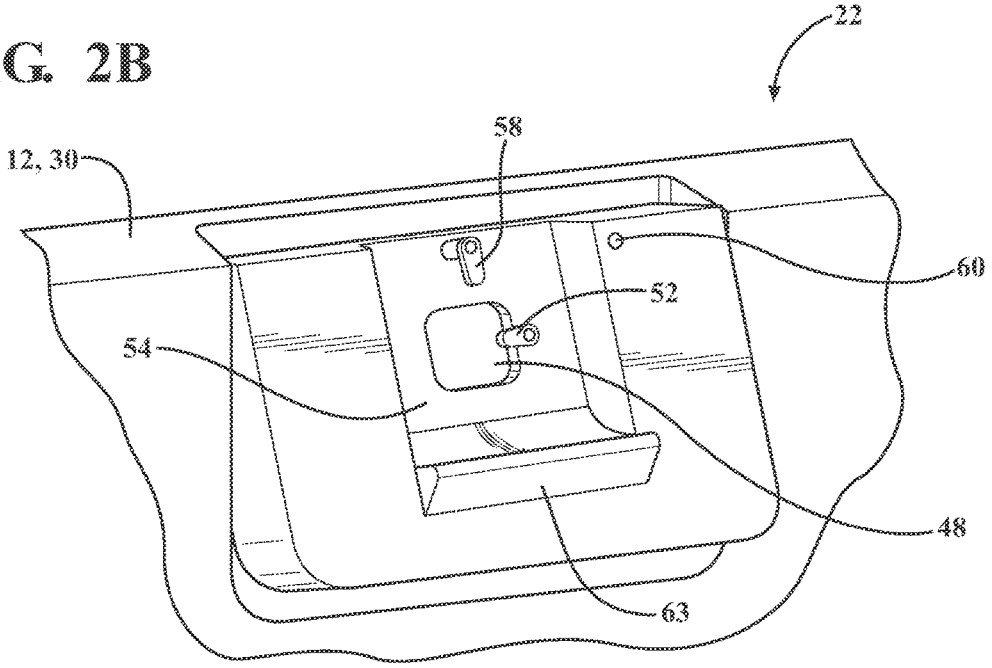
FIG. 2B is another example wherein the receptacle is pivoted upwards.
Figure 2C:
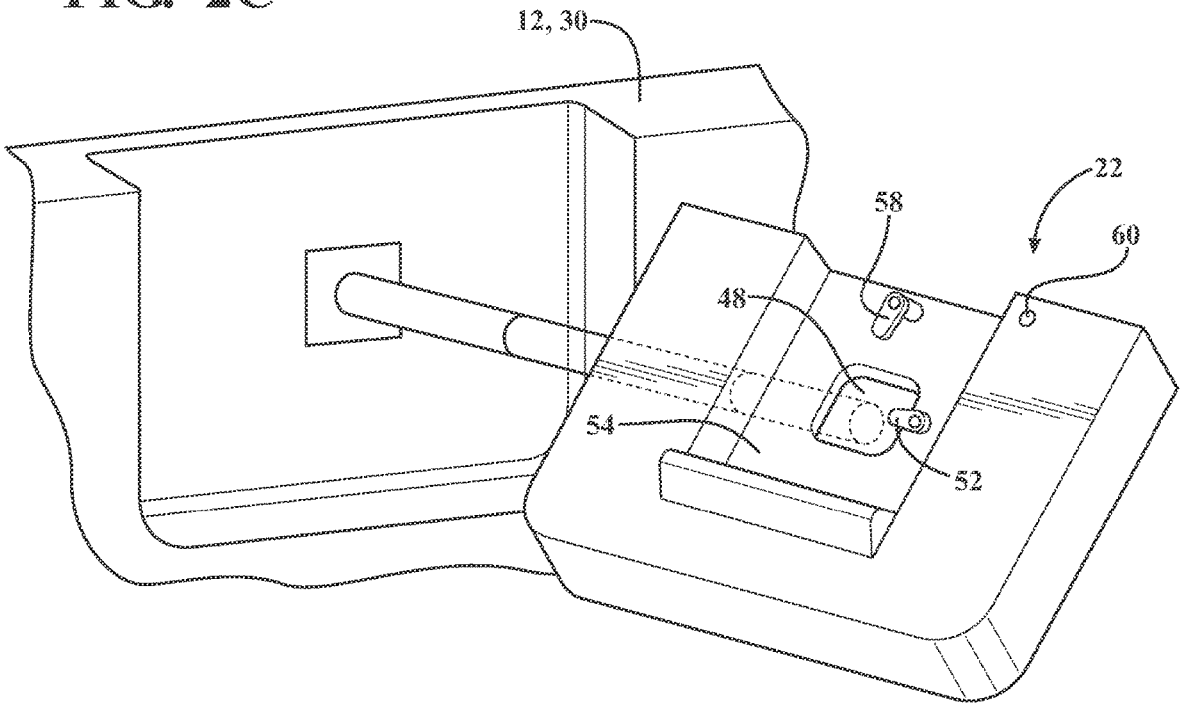
FIG. 2C is another example wherein the receptacle is moveable from a support structure of the patient support apparatus.

In one example, as shown in FIGS. 2A and 2B, the receptacle 22 may be pivoted from the side rail 30. Pivoting provides accessibility options to the receptacle 22 for convenience of the patient. The receptacle 22 is shown in the Figures to be on the patient support apparatus 10 facing inwards. It will be appreciated that the receptacle 22 may pivot outwards from the patient support apparatus 10 for convenience of other individuals such as nurses, doctors and/or visitors. Depending on the location of the receptacle 22, such pivoting may be from various directions and/or implemented by techniques other than that shown in the Figures.

In another embodiment, as shown in FIG. 2C, the receptacle 22 may be movable with respect to the support structure 12 according to numerous degrees of freedom, e.g., six degrees of freedom. For example, the receptacle 22 may be coupled to an extendable arm comprising one or more adjustable joints. The extendable arm may be manually adjusted or may be adjusted using motor/joint actuation. The receptacle 22 may be coupled to a distal end of the extendable arm and may be configured to pivot in various directions, such as pivoting flat like a tray table, etc.

The first surface 48 of the receptacle 22 is configured to receive the charging device 62. The first surface 48 may be designed to accommodate or house the charging device 62. As such, the configuration of the first surface 48 may depend on the size and shape of the charging device 62.

The second surface 54 of the receptacle 22 is configured to receive the external electronic device 64. The second surface 54 may be designed to accommodate or house the external electronic device 64. As such, the configuration of the second surface 54 may depend on the size and shape of the external electronic device 64.

In the examples shown throughout the Figures, the second surface 54 completely surrounds the first surface 48. In other words, a perimeter of the first surface 48 is encompassed within a perimeter of the second surface 54. However, there may be other examples where perimeters of the first and second surfaces 48, 54 partially overlap, or do not overlap at all.

In the examples shown throughout the Figures, the first surface 48 is non-planar with respect to the second surface 54. In other words, the first surface 48 and the second surface 54 are layered at different depths, e.g., such that the first surface 48 is lower than the second surface 54. In one example, the depth between the first and second surfaces 48, 54 corresponds to a depth of the charging device 62. With such corresponding depths, placement of the charging device 62 on the first surface 48 enables an exterior surface of the charging device 62 to be flush with the second surface 54. However, in other examples, the first and second surfaces 48, 54 may be disposed coplanar with one other. For example, the first and second surfaces 48, 54 may be disposed side-by side on the same plane, and the like. The first surface 48 may be separated from the second surface 54 by any physical characteristic, such as a change in material, a change in surface depth, or the like.

As shown in FIG. 2, the receptacle 22 may comprise a support member 63. The support member 63 is configured to support positioning of the external electronic device 64 on the receptacle 22. For example, the support member 63 may be provided to counteract gravitational forces on the external electronic device 64 when the external electronic device 64 is "standing up" or vertically positioned on the receptacle 22. In other examples, the support member 63 may be provided to counteract horizontal forces on the external electronic device 64 resulting from inadvertent bumping of the receptacle 22, movement of the patient support apparatus 10, and the like.

The support member 63 may have any suitable design or curvature to prevent the external electronic device 64 from falling or slipping off the receptacle 22. For example, as shown in FIG. 2, the support member 63 supports the external electronic device 64 from below with a curved ledge configuration.

The second surface 54 and the support member 63 may function cooperatively to secure the external electronic device 64. In some embodiments, the second surface 54 and the support member 63 may be a common integrally formed surface. In other examples, the support member 63 may be of a different material, or the like.

The securing mechanisms 52, 58 are configured to secure the charging device 62 and the external electronic device 64, respectively, to the receptacle 22. Securing mechanisms 52, 58 may further be configured to provide alignment of the devices 62, 64 for wireless power/data transfer. Securing mechanism 52, 58 may comprise a mechanical connection, an electromechanical connection, and/or an electromagnetic connection. A mechanical connection may comprise a lock such as a mechanical interlock and latch, a clip, a clamp, a snap fit and the like. An electromechanical connection may be an actuated latch, etc. An electromagnetic connection may comprise a magnet such that a magnetic attraction occurs to provide alignment.

In one embodiment, the surfaces 48, 54 of the receptacle 22, charging device 62, and external electronic device 64 may include a magnet or be of magnetic material. The attractive magnetic force between the magnet and the magnetic material or another magnet aligns the charging device 62 or external electronic device 64 to the receptacle 22. The magnets of the charging device 62 and/or the external electronic device 64 are orientated such that the devices 62, 64 may be magnetized to the receptacle 22. The charging device 62 and/or the external electronic device 64 may be disposed within the vicinity of the first surface 48 and/or second surface 54, respectively, such that a magnetic attraction occurs to align, the charging device 62 and/or the external electronic device 64.

The charging device 62 is portable and is easily removable from the first surface 48, without exercising a substantial force. For example, the charging device 62 may be removed from the first surface 48 and utilized remotely or portably away from the receptacle 22. The communication and/or transmission range between the charging device 62 and the receptacle 22 may be any suitable range depending on design considerations.

Figure 3:
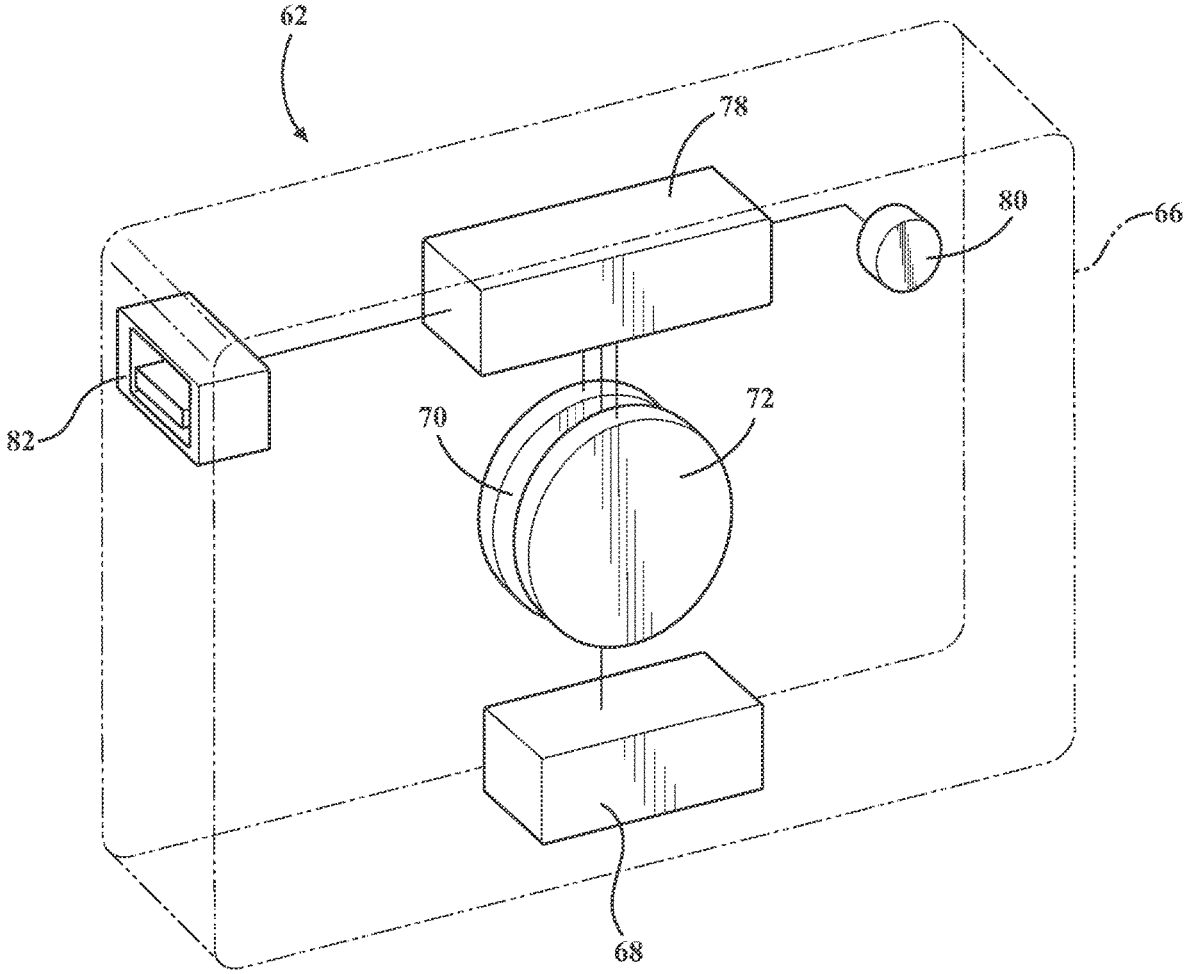
FIG. 3 is a perspective view, partially in phantom, of one example of the portable charging device and sub-components thereof.

As shown in FIG. 3, the charging device 62, according to one example, comprises a housing 66. The shape and size of the housing 66 of the charging device 62 may take on any suitable shape, size, and material, and is not limited to that specifically set forth or shown in the Figures. For example, the housing 66 may be of a cylindrical shape. It will be appreciated that the housing 66 may be configured to store objects not mentioned in this description.

Within the housing 66, or coupled to the housing 66, the charging device 62 comprises an energy storage unit 68 for storing energy, a sending element 70 and a receiving element 72 for power/data transmission, a controller 78 for controlling capabilities of the charging device 62, an indicator 80 for providing the user of the charging device 62 with information, and an interface 82 for enabling wired connection to the charging device 62 for power/data transfer, e.g., to the external electronic device 64.

The energy storage unit 68 of the charging device 62 may be coupled to the sending element 70, receiving element 72, controller 78, and interface 82 to provide energy thereto.

The sending element 70 and/or receiving element 72 may be integrated into any suitable arrangement and location of the charging device 62. For example, the charging device 62 may comprise elements 70, 72 disposed inside the housing 66. In other embodiments, the elements 70, 72 may be integrated on the exterior of the housing 66. Furthermore, any number of elements 70, 72 may be utilized. For example, the charging device 62 may comprise one element that acts as both sending and receiving elements 70, 72. Additional details about the sending element 70 and receiving element 72 of the charging device 62 are described below.

Figure 4:
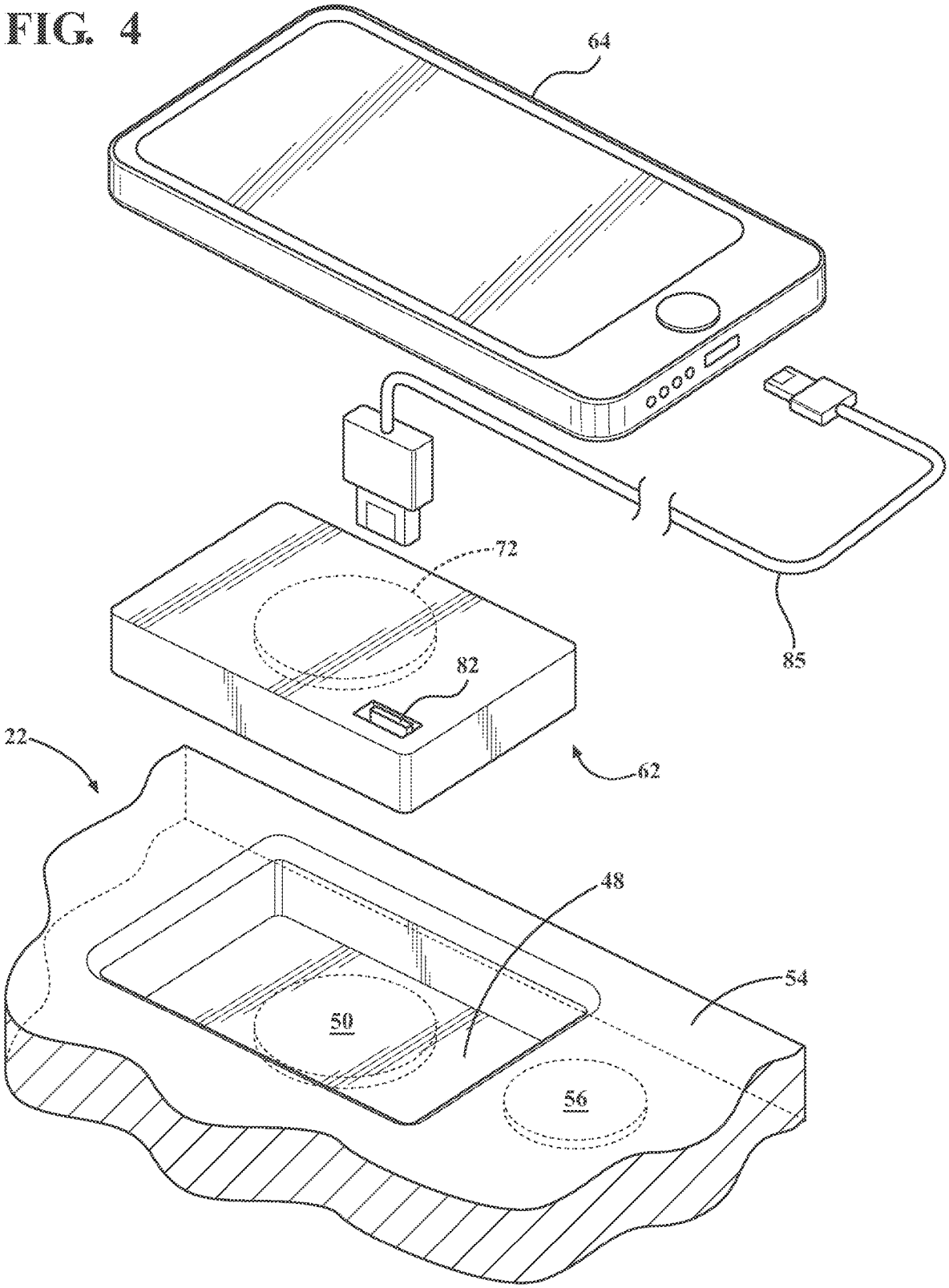
FIG. 4 is an assembly view, partially in phantom, showing interplay between an external electronic device, the charging device, and the receptacle of the patient support apparatus according to one embodiment.

As shown in FIG. 4, the receptacle 22 may comprise the surfaces 48, 54 including two sending elements 50, 56, respectively, for transferring power/data. The first sending element 50 of the receptacle 22 interacts with the receiving element 72 of the charging device 62 when the charging device 62 is disposed on the first surface 48. The second sending element 56 of the receptacle 22 interacts with a receiving element 92 (not shown) of the external electronic device 64 when the external electronic device 64 is disposed on the second surface 54.

The controller 78 of the charging device 62 is in communication with and for controlling any suitable components of the charging device 62, such as the electrical or electromechanical components described herein. The controller 78 may comprise any suitable signal processing means, computer executable instructions or software modules stored in a non-transitory memory wherein the executable instructions or modules may be executed by a processor, or the like. Additionally, or alternatively, the controller 78 may comprise a microcontroller, a processor, one or more integrated circuits, logic parts, and the like for enabling the same. The controller 78 may have any suitable configuration for enabling performance of various tasks related to operation of the charging device 62, such as those described below. The controller 78 may be located at any suitable location within the housing 66 of the charging device 62.

As shown in FIGS. 2 and 3, one or more indicators 60, 80 are configured to indicate a presence/absence of a connection. The indicators 60, 80 may be a visual indicator such as a flashing or illuminated light and/or an audio indicator, such as a sound notification. Indicator 60 is located on the receptacle 22. Indicator 80 is located on the charging device 62, e.g., on the housing 66. The indicator 60, 80 may be located at any suitable location on the receptacle 22 and the charging device 62, respectively. Indicator 60 may be activated when there is a successful power/data connection between the charging device 62 and the receptacle, i.e., first surface 48. Indicator 80 may be activated when there is a successful power/data connection between the charging device 62 and the external electronic device 64.

Referring to FIG. 4, the interface 82 of the charging device 62 comprises one or more connectors configured to facilitate direct physical connection to the external electronic device 64 via a cable 85. It will be appreciated that the connector may be a port, a jack, an outlet, and the like. The interface 82 may have any female or male configuration. As shown in FIG. 4, the interface 82 is a universal serial bus (USB) port. In one embodiment, the interface 82 may be a cable 85 connected to the housing 66 at a proximal end and one or more connector heads (not shown) at the distal end.

It will be appreciated that other types or configurations of the interface 82 may be used alternatively or in addition to those mentioned herein.

The charging device 62 may comprise a mechanism configured to manage the cable 85. The mechanism may be a reel or a sleeve to help the user bundle or wrap the cable 85 about the charging device 62. In another embodiment, the cable 85 may be retractable into the charging device 62.

The charging device 62 may further comprise a securing mechanism configured to secure the external electronic device 64 to the charging device 62. The securing mechanism may be configured to provide alignment between the elements 70, 92 of the charging device 62 and external electronic device 64, respectively, for wireless transfer. Securing mechanism may comprise a mechanical connection, electromechanical connection, and/or electromagnetic connection. A mechanical connection may comprise a lock such as a mechanical interlock and latch, a clip, a clamp, a snap fit and the like. An electromechanical connection may be an actuated latch or the like. An electromagnetic connection may comprise a magnet such that a magnetic attraction occurs to provide alignment. In one embodiment, the housing 66 may include a magnet or be of magnetic material. The attractive magnetic force between the magnet and the magnetic material or another magnet aligns the external electronic device 64 to the charging device 62. The magnets of the charging device 62 and the external electronic device 64 are orientated such that the devices 62, 64 may be magnetized to each other.

Figure 5:
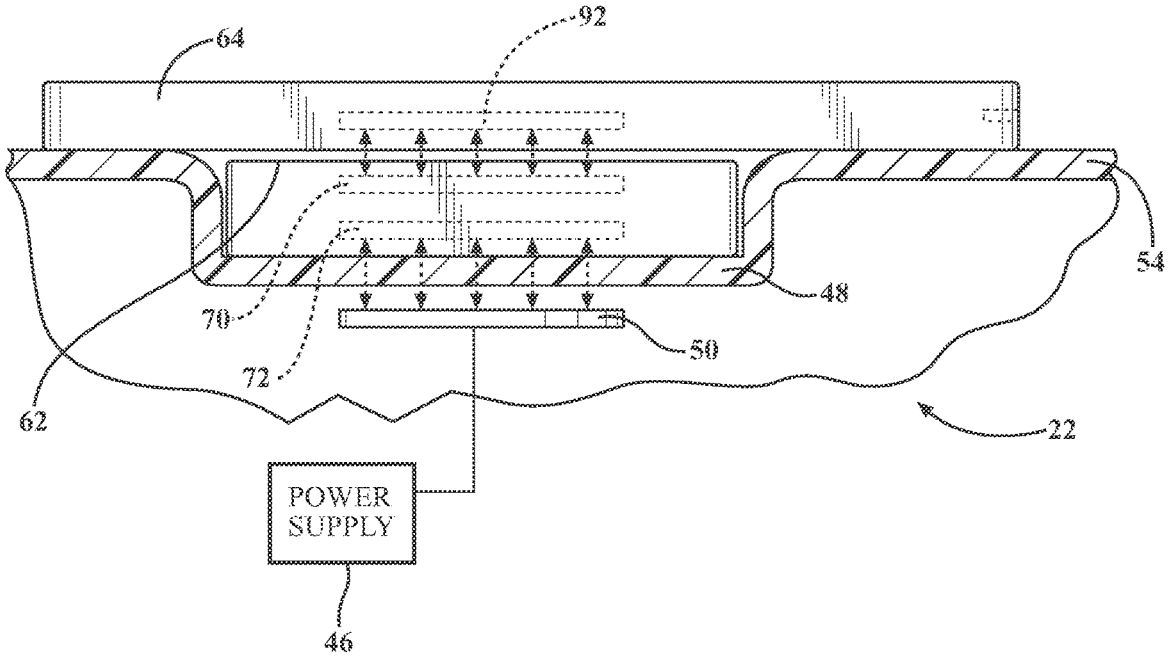
FIG. 5 is a side view, partially in phantom, of one example showing the charging device disposed on a first surface the receptacle and the external electronic device disposed on a second surface of the receptacle whereby the charging device is wirelessly charged by the receptacle and the external electronic device is wirelessly charged by the charging device.
Figure 6:
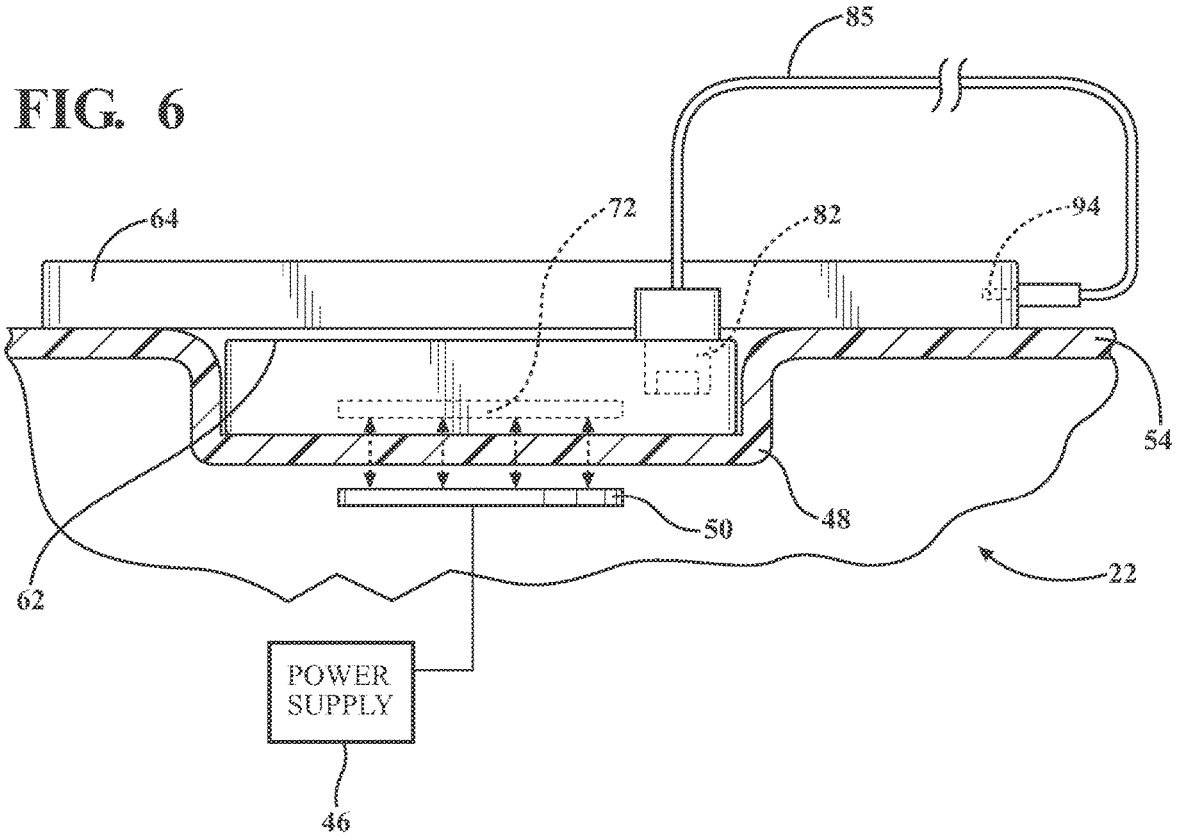
FIG. 6 is a side view, partially in phantom, of another example showing the charging device disposed on the first surface the receptacle and the external electronic device disposed on the second surface of the receptacle whereby the external electronic device is charged by the charging device using a physical connection.
Figure 7:
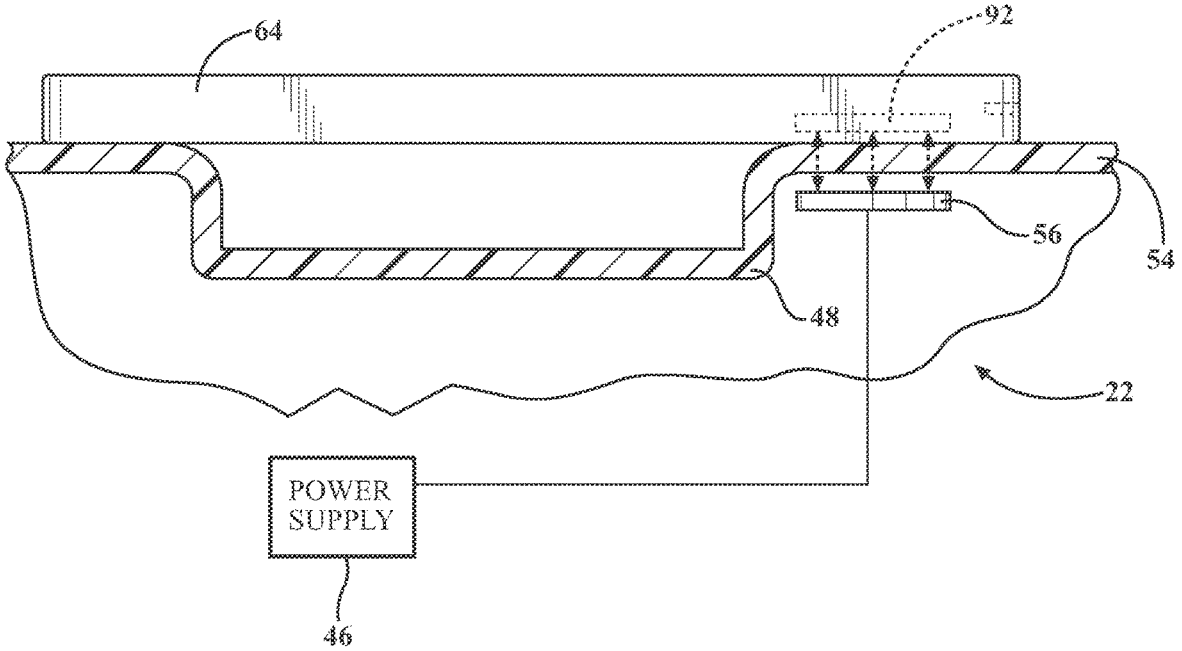
FIG. 7 is a side view, partially in phantom, of one example showing the external electronic device disposed on the second surface of the receptacle whereby the external electronic device is wirelessly charged by the second surface of the receptacle.

FIGS. 5-7 illustrate different transfer paths/techniques between the receptacle 22, the charging device 62 and the external electronic device 64. In FIGS. 5-7, wireless power/data transfer is implemented using electrically-based transfer between one or more sending elements 50, 56, 70 and one or more receiving elements 72, 92. Specifically, transfer may be implemented using inductive transfer and/or capacitive transfer. To implement these techniques, a receiving element is moved towards a sending element, and hence, the receiving element is proximate to the sending element. The sending element and receiving element are energized and inductive and/or capacitive interaction is created between the electrical elements. Power/data is transferred to the external electronic device 64 in response to the inductive and/or capacitive interaction.

As for inductive transfer, any of the sending elements 50, 56, 70 comprise a sending coil and any of the receiving elements 72, 92 comprise a receiving coil. Inductive transfer occurs from the sending coil to the receiving coil. The coils are each electrical inductors and are operable together to form a transformer. The sending element may be coupled to a transmitter circuit, such as an oscillator, coupled to the power supply 46 for energizing the sending coil using AC current. As the AC current passes through the sending coil, a magnetic field is generated and passes through the receiving coil. Upon wirelessly receiving the magnetic field, the receiving coil induces AC current. The receiving element may comprise a receiver circuit for receiving the AC current induced by the receiving coil. For example, the receiver circuit may be a rectifier circuit for converting the AC current into DC current suitable for the patient support apparatus 10 and/or power supply 46.

For capacitive transfer, any of the sending elements 50, 56, 70 comprise a sending plate and any of the receiving elements 72, 92 comprise a receiving plate. Capacitive transfer occurs from the sending plate to the receiving plate. The plates are each electrical conductors (e.g., electrodes) and are operable together to form a capacitor. A transmitter circuit applies AC voltage to the sending plate. In turn, an electric field is generated and passes to the receiving plate. Upon wirelessly receiving the electric field, the receiving plate induces AC voltage. The receiver circuit utilizes the AC voltage to facilitate the flow of AC current suitable for the patient support apparatus 10 and/or power supply 46. The capacitive plates may be arranged in a unipolar or bipolar configuration.

The specific geometries of the coils and/or specific integration of the coils with the receptacle 22, the charging device 62, and the external electronic device 64 may differ from specific geometries and/or integration of the plates for each of these examples. This is due to the nature of inductive power transfer requiring coils and capacitive power transfer requiring plates for proper operation. However, those skilled in the art can readily recognize specific geometries and/or integration of plates in view of the teachings described herein relating to the coils. To capture this commonality, the coils and/or plates in the embodiments described below are referred to sending elements and receiving elements.

The embodiment of FIG. 5 provides a wireless configuration for charging the external electronic device 64. The first surface 48 of the receptacle 22 comprises the first sending element 50, which wirelessly transfers power/data to the receiving element 72 of the charging device 62. At the same time, or at a different time, the sending element 70 of the charging device 62 wirelessly transfers power/data to the receiving element 92 of the external electronic device 64 for charging. As such, FIG. 5 shows a purely wirelessly transfer path between different devices.

The power transferred to the external electronic device 64 is generally the same power transferred wirelessly to the charging device 64 from the receptacle 22. This power is stored in the energy storage device 68 of the charging device 62. In another instance, some of the power transferred to the external electronic device 64 may pre-stored in the energy storage device 68 such that such power is not directly acquired from the receptacle 22 at the time of positioning of the charging device 62 on the first surface 48. The illustration of FIG. 5 applies to both wireless power transfer as well as wireless data transfer.

In another example, as shown in FIG. 6, the charging device 62 wireless receives power from the first surface 48, similar to the configuration of FIG. 5. However, instead of wirelessly transferring power/data from the charging device 62 to the external electronic device 64, the cable 85 is utilized to physically connect these devices 62, 64 for charging. If the user desires to utilize the external electronic device 64, while at the same time desires to have the external electronic device 64 be charged, the user can remove both of these devices 62, 64, including the cable 85, from the vicinity of the receptacle 22 and functionality of the charging device 62 will remain intact. The illustration of FIG. 6 applies to both wireless power transfer as well as wireless data transfer.

FIG. 7 illustrates a feature of the receptacle 22 that is supplemental to the examples of FIGS. 5 and 6. Mainly, the receptacle 22 is equipped with the second sending element 56, which in this example, is under the second surface 54. The second sending element 56 is configured to wirelessly transfer power/data to the receiving element 92 of the external electronic device 64. Even with operation of the second sending element 56, power/data may be transferred to the external electronic device 64 using the first sending element 70 (FIG. 5) and/or through the interface 82 (FIG. 6). The illustration of FIG. 7 applies to both wireless power transfer as well as wireless data transfer.

Figure 8:
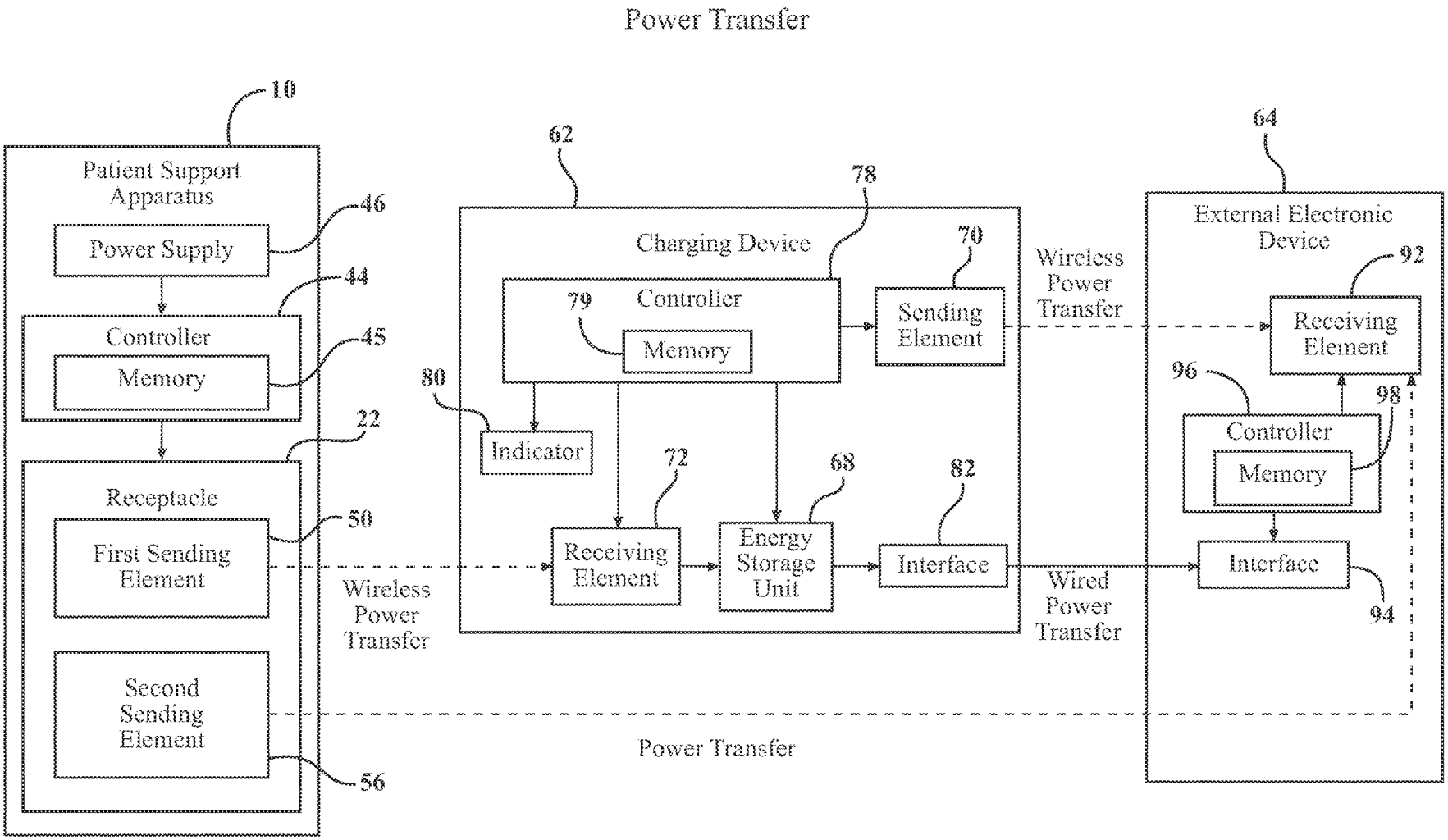
FIG. 8 is a block diagram of one example of a power transfer system implemented between the receptacle, the charging device, and the external electronic device, and components thereof.
Figure 9:
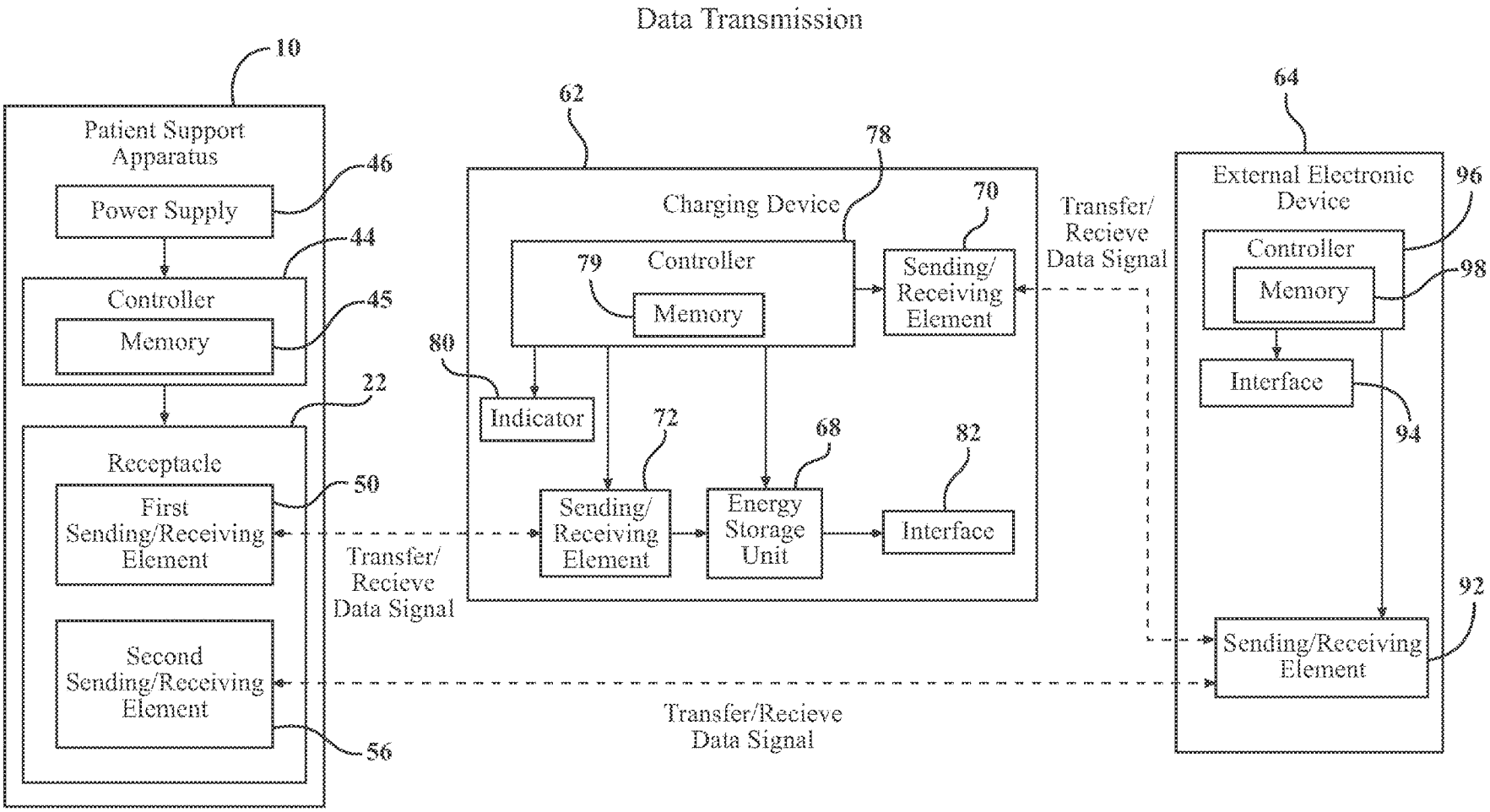
FIG. 9 is a block diagram of one example of a data transfer system implemented between the receptacle, the charging device, and the external electronic device, and components thereof.

Turning to FIGS. 8 and 9, block diagrams are provided to illustrate power transfer and data transfer paths among the various components of the patient support apparatus 10, the charging device 62, and the external electronic device 64.

In FIG. 8, the block diagram demonstrates the various power transfer paths whereby the sending element 50 (receptacle 22) wirelessly transfers power to the receiving element 72 (charging device 62), the second sending element 56 (receptacle 22) wirelessly transfers power to the receiving element 92 (external electronic device 64), and the sending element 70 (charging device 62) wirelessly transfers power to the receiving element 92 (external electronic device 64). Wired power transfer may occur from the interface 82 (charging device 62) to an interface 94 of the external electronic device 64. Those skilled in the art can appreciate that other power transfer paths besides those shown in FIG. 8 are possible in the spirit of the techniques described herein.

The controller 44 of the patient support apparatus 10 may provide command signals for disabling, enabling, or otherwise controlling transfer capabilities or parameters of the elements 50, 66 of the receptacle 22. The controller 78 of the charging device 62 may provide command signals for disabling, enabling, or otherwise controlling transfer capabilities or parameters of the elements 70, 72 on the charging device 62. Similarly, a controller 96 of the external electronic device 64 may provide command signals for disabling, enabling, or otherwise controlling transfer capabilities or parameters of the receiving element 92 on the external electronic device 64.

As shown in FIG. 9, the patient support apparatus 10, the charging device 62, and the external electronic device 64 are in communication such that data signals may be transferred and/or received between the various sending/receiving elements. The transfer of data is over a wireless communication channel, as shown in FIG. 9. It will be appreciated that the data communication between the charging device 62 and the external electronic device 64 may be through other communication channels such as copper wires, optical fibers, and the like. Those skilled in the art can appreciate that other data transfer paths besides those shown in FIG. 9 are possible in the spirit of the techniques described herein.

The patterns of the sending elements and receiving elements may be different from that shown in the Figures. For example, certain elements may be encompassed by others. Furthermore, the sending elements and receiving elements may be of various sizes and/or geometries based on factors, such as anticipated interaction of the charging device 62, the external electronic device 64 and the surfaces 48, 54 of the receptacle 22, geometry of the charging device 62, properties of the sending elements and receiving elements, and the like.

It will be further appreciated that the terms "include," "includes," and "including" have the same meaning as the terms "comprise," "comprises," and "comprising." Moreover, it will be appreciated that terms such as "first," "second," "third," and the like are used herein to differentiate certain structural features and components for the non-limiting, illustrative purposes of clarity and consistency.

Several configurations have been discussed in the foregoing description. However, the configurations discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

The invention is intended to be defined in the independent claims, with specific features laid out in the dependent claims, wherein the subject-matter of a claim dependent from one independent claim can also be implemented in connection with another independent claim.

The invention claimed is:

1. A patient support apparatus comprising:

a support structure;

a power supply;

a charging device being portable and comprising an energy storage unit and a receiving element coupled to the energy storage unit and with the receiving element being configured to wirelessly receive power; and a receptacle operatively attached to the support structure and arranged for pivotal movement with respect to the support structure while remaining operatively attached to the support structure, the receptacle comprising a surface including a sending element being coupled to the power supply and with the surface being configured to receive the charging device for concurrent pivotal movement with the receptacle relative to the support structure, and with the charging device being removable from the surface while the receptacle remains operatively attached to and pivotable relative to the support structure;

wherein the sending element is configured to wirelessly transfer power to the receiving element of the charging device such that the energy storage unit of the charging device stores the transferred power for charging an external electronic device.

2. The patient support apparatus of claim 1, wherein the charging device is configured to transfer data to/from the receptacle and/or the external electronic device.

3. The patient support apparatus of claim 1, wherein:

the receiving element comprises a receiving coil and the sending element comprises a sending coil to facilitate wireless inductive transfer between the receiving and sending coils; or the receiving element comprises a receiving electrode and the sending element comprises a sending electrode to facilitate wireless capacitive transfer between the receiving and sending electrodes.

4. The patient support apparatus of claim 1, wherein the receptacle further comprises a first securing mechanism configured to secure the charging device to the surface.

5. The patient support apparatus of claim 1, wherein the surface is a first surface and wherein the receptacle further comprises a second surface being non-planar with the first surface and with the second surface being configured to receive the external electronic device.

6. The patient support apparatus of claim 5, wherein the second surface comprises a second sending element being coupled to the power supply and being configured to wirelessly transfer power to a receiving element of the external electronic device.

7. The patient support apparatus of claim 5, wherein the receptacle further comprises a second securing mechanism configured to secure the external electronic device to the second surface.

8. The patient support apparatus of claim 1, wherein the receptacle and/or the charging device comprise an indicator configured to indicate a power or data connection between the sending element and the receiving element.

9. The patient support apparatus of claim 1, wherein the receptacle is arranged for movement with respect to the support structure in a plurality of degrees of freedom.

10. The patient support apparatus of claim 1, further comprising an arm coupled between the receptacle and the support structure.

11. The patient support apparatus of claim 10, wherein the arm is extendable to move the receptacle relative to the support structure.

12. The patient support apparatus of claim 10, wherein the arm includes one or more adjustable joints to move the receptacle relative to the support structure.

13. A patient support apparatus comprising:

a support structure;

a power supply;

a charging device being portable and comprising an energy storage unit and a receiving element coupled to the energy storage unit and with the receiving element being configured to wirelessly receive power; and a receptacle operatively attached to the support structure and arranged for pivotal movement with respect to the support structure while remaining operatively attached to the support structure, the receptacle comprising a first surface and a second surface, the first surface including a first sending element being coupled to the power supply and with the first surface being configured to receive the charging device for concurrent pivotal movement with the receptacle relative to the support structure, and with the charging device being removable from the first surface while the receptacle remains operatively attached to and pivotable relative to the support structure, the second surface including a second sending element coupled to the power supply, wherein:

the first sending element is configured to wirelessly transfer power to the receiving element of the charging device such that the energy storage unit of the charging device stores the transferred power for charging an external electronic device, and the second sending element is configured to wirelessly transfer power to a receiving element of the external electronic device.

14. The patient support apparatus of claim 13, wherein the charging device is configured to transfer data to/from the receptacle and/or the external electronic device.

15. The patient support apparatus of claim 13, wherein:

the receiving element comprises a receiving coil and the first sending element comprises a sending coil to facilitate wireless inductive transfer between the receiving and sending coils; or the receiving element comprises a receiving electrode and the first sending element comprises a sending electrode to facilitate wireless capacitive transfer between the receiving and sending electrodes.

16. The patient support apparatus of claim 13, wherein the receptacle further comprises a first securing mechanism configured to secure the charging device to the surface.

17. The patient support apparatus of claim 13, wherein the second surface is at least one of non-planar and parallel with the first surface and with the second surface being configured to receive the external electronic device.

18. The patient support apparatus of claim 13, further comprising an arm coupled between the receptacle and the support structure.

19. The patient support apparatus of claim 18, wherein the arm is extendable to move the receptacle relative to the support structure.

20. The patient support apparatus of claim 18, wherein the arm includes one or more adjustable joints to move the receptacle relative to the support structure in a plurality of degrees of freedom.

* * * * *